United States Patent [19]

Lowe

[11] Patent Number: 5,058,733

[45] Date of Patent: Oct. 22, 1991

[54] DISPLAY CASE FOR A MARSHALL ART BELT

[76] Inventor: Kelley M. Lowe, 10356 Vera Cruz Ct., San Diego, Calif. 92124

[21] Appl. No.: 514,548

[22] Filed: Apr. 26, 1990

[51] Int. Cl.[5] ..... B65D 25/00; B65D 85/18

[52] U.S. Cl. ..... 206/45.34; 206/298

[58] Field of Search ..... 206/278, 298, 45.19, 206/45.14, 45.34, 44 R, 45.15

[56] References Cited

U.S. PATENT DOCUMENTS

| | | | |
|---|---|---|---|
| 1,463,948 | 8/1923 | Geimer | 206/278 X |
| 1,516,821 | 11/1924 | Knothe | 206/45.14 |
| 1,691,936 | 11/1928 | Peter | 206/45.19 |
| 2,438,805 | 3/1948 | Hoyle | 206/45.34 |
| 2,442,979 | 6/1948 | Larson | 206/45.34 |
| 2,649,956 | 8/1953 | Knibb | 206/45.34 |
| 2,681,731 | 6/1954 | Chambers | 206/45.34 X |
| 2,806,590 | 9/1957 | Larson | 206/45.34 X |
| 2,991,874 | 7/1961 | Brandt | 206/45.34 X |
| 4,802,577 | 2/1989 | O'Leary | 206/45.34 |

FOREIGN PATENT DOCUMENTS

| | | | |
|---|---|---|---|
| 468564 | 10/1950 | Canada | 206/298 |
| 637430 | 5/1950 | United Kingdom | 206/298 |

*Primary Examiner*—William I. Price

*Attorney, Agent, or Firm*—Frank D. Gilliam

[57] ABSTRACT

The disclosure is directed to a rectangular housing for a buckle less belt used in the marshall arts to denote expertise in that marshall art. The housing is designed to contain a belt in a coiled state. The belt is coiled around a centrally positioned cylindrical post. A portion of the belt may be held in position either on the post by means of a medallion denoting the specific marshall art sport or loosely coiled to fit firmly against the sides of the housing. The medallion is circular with a diameter larger than the post and is centrally attached to and positioned on the distal end of the post. The post is fixedly attached to the back wall of the housing.

4 Claims, 3 Drawing Sheets

DISPLAY CASE FOR A MARSHALL ART BELT

BACKGROUND OF THE INVENTION

The invention is directed to display or trophy cases and more particularly to a display case for a marshall art belt that denote expertise and advancement in that marshall art.

U.S. Pat. No. 629,840 teaches a display case for displaying a plurality of pocket knifes which are held to the interior of the case by resilient means.

U.S. Pat. No. 1,463,948 teaches a belt box used for packaging and display of the belt coiled therein. The belt is confined in the box with the buckle displayed exterior of the box.

U.S. Pat. No. 1,516,821 teaches a display box for a waist belt. The belt and buckle is coiled within the box and is attached to the bottom of the box by attachment means. There is no indication that the belt is easily removable or replaceable in the box. The box's outside periphery is a combination curvilinear and rectilinear surfaces.

U.S. Pat. No. 1,518,219 teaches a display box for a belt and suspenders. The box has two internal compartments one for each item. A raised central portion in the belt compartment is used to position the belt buckle for display.

U.S. Pat. No. 1,691,936 teaches a presentation or display box for a coiled belt with the buckle positioned in the center of the coiled belt on a raised pedestal. The belt and buckle are removably attached to the bottom of the box for transport and display.

U.S. Pat. No. 3,370,702 teaches a trophy or display case for a ring.

There has not been a presentation or display case for containing a buckle less belt representative of a marshall art which is removable and replaceable therein until the emergence of the present invention.

SUMMARY OF THE INVENTION

The trophy case of the present invention is rectangular shaped housing with either an open face or a face covered with a clear glass or plastic. The rear of the housing is enclosed with a solid back panel. Centrally positioned within the housing and facing the front thereof is a cylindrical post which is fixedly attached to the back surface by a screw or the like. A medallion or medal indicative of a particular marshall art with a diameter greater than the post is fixedly attached to the distal end of the post. The front edge surface of the housing periphery is concave with an adjacent inner surface slanted toward the center of the housing.

In use a buckle less belt indicative of a marshall art is coil wound around the post between the back surface of the housing and the back surface of the medallion confining a portion of the edge surface of the wound belt between the back of the medallion and the back surface of the housing. After the belt is fully wound first around the post with the remainder wound upon itself until the entire length of the belt is confined within the housing. Where a short belt is positioned in the housing it is loosely wound so that the outer periphery of the belt is against the sides of the housing. A transparent front surface may be included to fully enclose the wound buckle less belt while the belt still remains visible for viewing. The transparent front may be held in place by any convenient means such as screws or the like.

An object of this invention is to provide a storing and/or display case for a buckle less belt of the selected marshall art.

Another object of this invention is to provide a display case for a buckle less belt of a marshall art with the display case including a centrally positioned decorative medallion that is recognizable as an indication of a particular marshall art and the level of expertise therein.

Still another object of this invention is to provide a display case for a single marshall art buckle less belt that accommodates the belt for display and allows for selective removal of the belt therefrom for use and for replacing the belt therein for display.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENT

Figure 1:
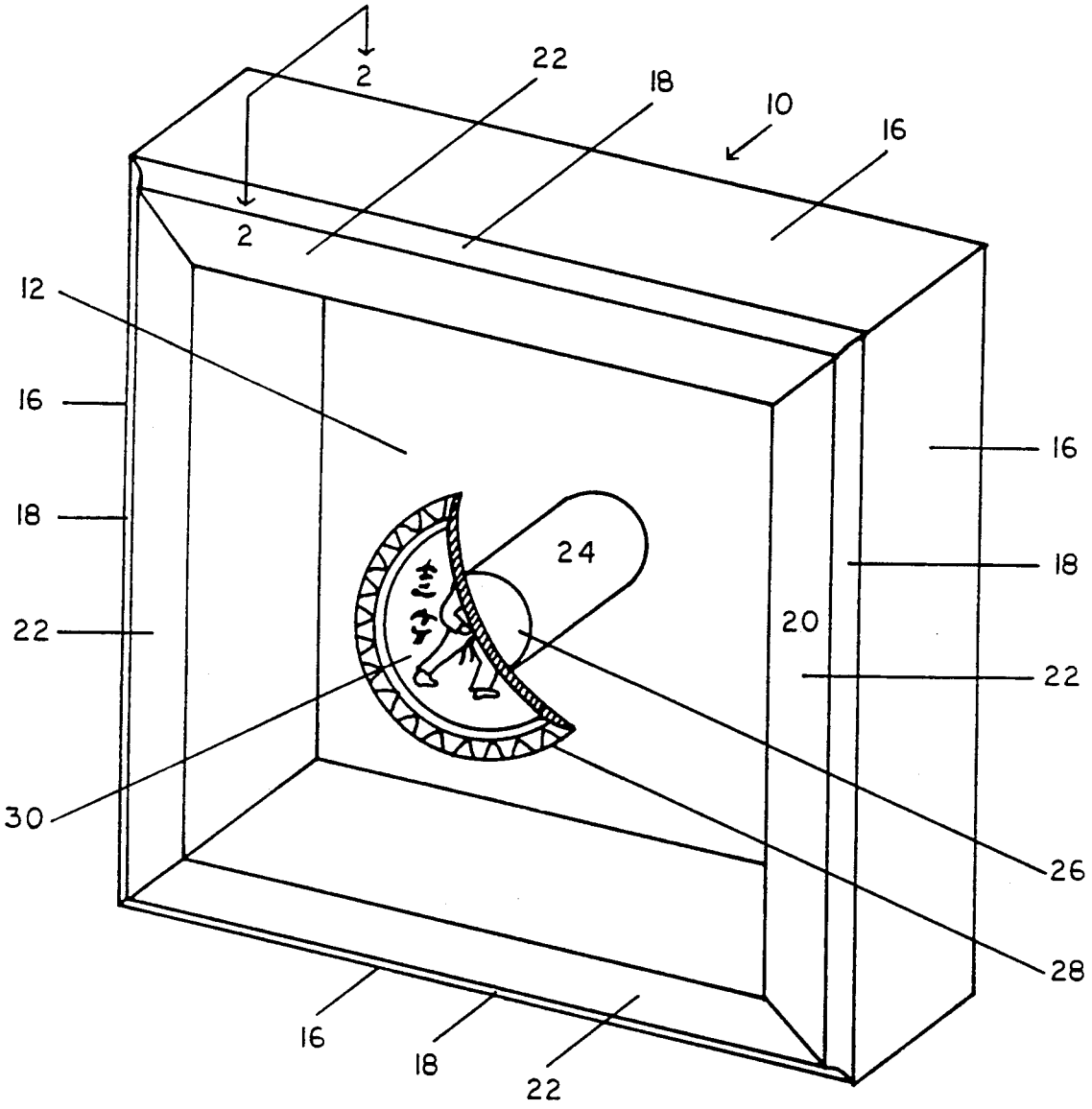
FIG. 1 is a front perspective showing depicting the display case of the invention.
Figure 2:
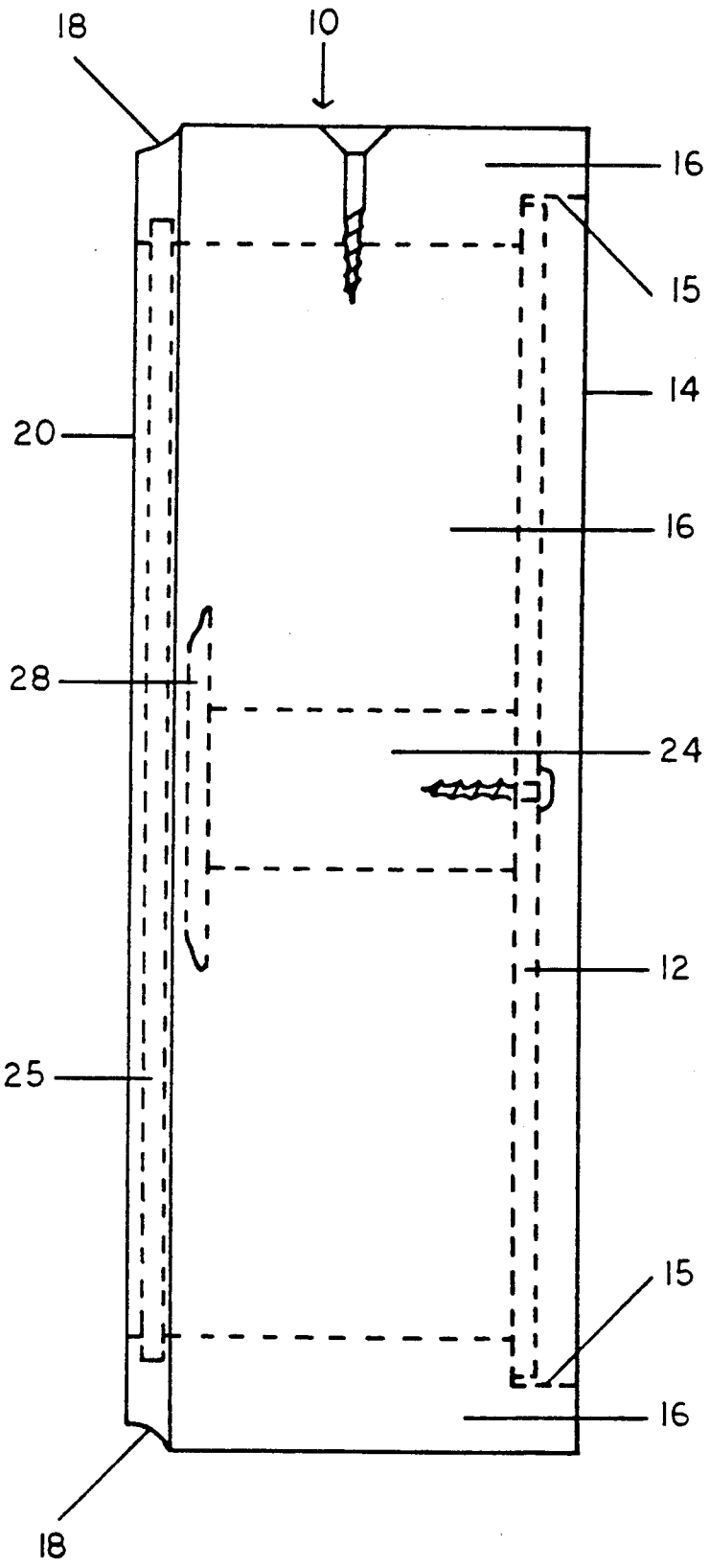
FIG. 2 is a section taken along line 2—2 of FIG. 1.

Referring now to the various drawing Figures and particularly to drawing FIGS. 1 and 2 which depict the trophy case 10 of the present invention. The display case includes an enclosed back wall 12 fixedly attached to the back 14 of the display case. The back portion is inset or counter sunk at 15 into the four side wall sections 16 which make up the display case housing to provide a smooth back surface 14 for the display case. The outer periphery 18 of the front surface 20 of the display case side wall sections 16 are concave and the front surface further includes an inner surface 22 inwardly slanted toward each other. The front periphery of the side wall sections present an eye pleasing appearance to the trophy case. Centrally positioned between the side walls 16 and fixedly attached to the back wall 12 is a cylindrical post 24. Attached to the distal end 26 of the post is a medallion 28 which has a greater diameter than the post 24 and has an exposed surface 30 configured or designed to be representative of a particular marshall art, by way of example and not by way of limitation, a showing of two combatants attired in appropriate garments for a particular marshall art. The medallion is generally adhesively bonded to the distal end of the post. A removable transparent cover 25 of glass, plastic or the like may be removably installed to enclose the front of the trophy case. The transparent cover can be attached by tongue and groove means or attached by removable screws not shown.

Figure 3:
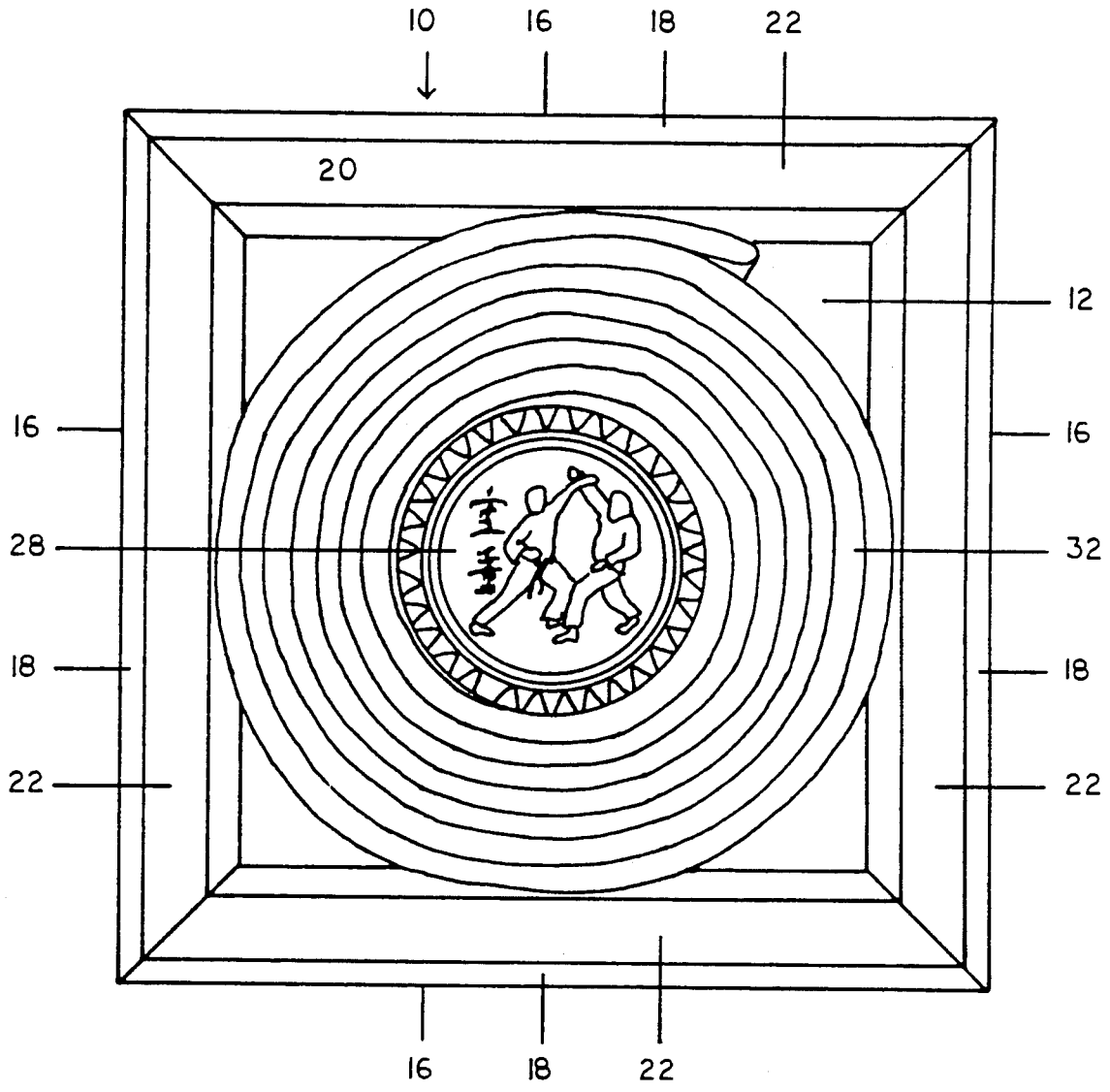
FIG. 3 is a front showing depicting the display case of the invention with a buckle less belt inplace therein.

Referring now to drawing FIG. 3, this Figure depicts a belt 32 of a particular style and color designating a level of expertise in a particular marshall art which is designated by the configuration or design on the face of the medallion 28 in display position within the trophy 10.

For installation of the belt 32 in the display case, one end of the belt is first wound on the cylindrical post and then wound upon itself until the entire belt is coiled as shown in drawing FIG. 3. The side walls 16 of the trophy may be sized so that a belt of a particular length can be easily wound within the display case with the last coil substantially in contact with at least one of the inner side wall surfaces. When smaller length belts for which the housing is designed are displayed the belt is loosely wound so that the belt contacts at least one of the housing walls and not necessarily wound or in contact with the cylindrical post.

The back, side walls and cylindrical post may be constructed of any suitable material such as, wood plastic or the like. The medallion 28 could be constructed of any suitable material such as, wood, plastic, plastic plated or flashed with a coating of metal, metal or the like.

While there have been shown and described preferred embodiments of the trophy of a marshall art sport in accordance with the invention, it will be appreciated that many changes and modifications may be made therein without, however, departing from the essential spirit thereof.

What is claimed is:

1. A marshall art display case for removably containing a buckle less belt denoting a level of expertise in a particular marshall art sport comprising:

a substantially square housing having a front and back surface, said back surface being enclosed and said front surface being open;

a cylindrical post within said house fixedly attached to and extending from the closed back surface toward the open front surface; and a medallion with a greater diameter than said cylindrical post having a front and back surface, said front surface denoting said particular marshal sport centrally positioned on and fixedly attached to the distal end of the cylindrical post whereby said buckle less belt can be wound around the cylindrical post and then upon itself between said closed back surface and said back surface of said medallion and is removably retained within said housing.

2. The invention as defined in claim 1 wherein said housing has a decorative front periphery.

3. The invention as defined in claim 1 further including a transparent removable front surface for attachment to the front of said housing whereby said buckle less belt and said medallion are visible through said transparent front surface when attached to said housing.

4. The invention as defined in claim 1 wherein said cylindrical post is centrally positioned on said back surface.

* * * * *